United States Patent [19]

Yonkers et al.

[11] Patent Number: 4,620,755

[45] Date of Patent: Nov. 4, 1986

[54] CABLE SHEATH CONNECTOR

[75] Inventors: John L. Yonkers, Northbrook; Edward H. Yonkers, Wilmette, both of Ill.

[73] Assignee: John L. Yonkers, Northbrook, Ill.

[21] Appl. No.: 607,572

[22] Filed: May 7, 1984

[51] Int. Cl.[4] ..... H01R 4/66

[52] U.S. Cl. ..... 339/14 L; 339/97 R; 174/78

[58] Field of Search ..... 339/14 R, 14 L, 95 R, 339/97 R; 174/78

[56] References Cited

U.S. PATENT DOCUMENTS

| | | | |
|---|---|---|---|
| 3,676,836 | 7/1972 | Gillemot et al. | 174/78 |
| 3,963,299 | 6/1976 | Thompson et al. | 339/95 R |
| 4,140,870 | 2/1979 | Volkers et al. | 339/14 L |
| 4,449,768 | 5/1984 | Koncelik et al. | 339/14 R |

*Primary Examiner*—Neil Abrams

*Attorney, Agent, or Firm*—Andrew J. Bootz

[57] ABSTRACT

There is provided a cable sheath connector for use with a communication cable of the type having a plurality of insulated conductor wires held in cylindrical form by an inner insulating plastic film wrapped tightly around the connectors and a thin metallic shield placed over the plastic film with a final outer protective cover. The connector includes an inner base and stud member, and an outer clamp member. The outer clamp member has an elongated body portion in cross section with projections extending inwardly, each of the projections having a flat contact area which will penetrate the outer protective cover of a cable and maintain metal to metal contact with the metal shield without piercing the shield. The outer clamp maintains compressive load on the shield clamped between the inner base and the outer clamp.

6 Claims, 7 Drawing Figures

CABLE SHEATH CONNECTOR

This invention relates to a cable sheath connector for use with a communication cable, such as a telephone cable. Such telephone cables characteristically have a number of insulated metallic conductor wires held in cylindrical form by an insulating plastic film wrapped tightly around the conductors; and a thin metal shield covers the plastic film. A final protective outer cover is formed over the metallic shield is usually a dielectric polymer such as polyethylene providing mechanical strength and a barrier to moisture and other environental conditions.

BACKGROUND OF THE INVENTION

The metallic shield of the telephone cable is a necessary element in the cable structure in that it serves to protect the inner electric circuits from disturbing effects of enviromental electrical phenomena, such as lightning and electric power system faults. In order to carry on this important funtion the cable shield must be securely connected to ground at intervals, and interconnected at cable splices. These connections between the shield and ground, and the shield to shield connections, must be of high integrity, that is, maintaining very low connection resistance under all enviromental conditions, such as mechanical stress, vibration, thermal change, and the like; and must be capable of carrying the high surge currents which may occur from lightning or power systems faults to ground.

The present invention relates to improvements in cable shield connection devices.

There are presently available several types of cable shield connectors or "bond clamps" as they are sometimes called in the industry. However, most of them fail to provide the mechanical and electrical integrity desired. One of the difficulties heretofore experienced which contributes to failures is the inherent difficulty in engaging the thin metal shield which is closely coupled to the outer plastic cover of the cable.

The present invention avoids the difficulty of engaging the metallic shield by penetrating the outer plastic cover with the projections on an outer clamping member in cooperation with an inner base carrying a threaded stud. The projections are provided with flat contact areas which will penetrate the outer protective cover of a telephone cable and will make metal to metal contact with the metallic shield without penetrating the shield.

However, the present system positions the projections symmetrically around the threaded stud so that the outer clamp with the contact projections may be pressed toward the inner base with the projections engaging the shield at symmetrical points around the stud, and the pressure and resiliency of the material of the outer clamp will provide and maintain metal to metal contact under high resilient force to maintain the required low connection resistance under all enviromental conditions.

The flat-ended projections are adapted to penetrate through the outer plastic cover of the telephone cable and to clamp the metallic shield against the inner base without penetrating or puncturing the metallic shield.

Accordingly, it is an object of the present invention to provide an improved cable sheath connector for a telephone cable.

Another object of the present invention is to provide a cable sheath connector for a telephone cable which will maintain a low connection resistance of the cable sheath over a wide range of enviromental conditions.

Still a further object of the present invention is to provide a cable sheath for a telephone cable which will clamp the metallic shield of the cable with a high resilient force without puncturing the cable shield.

Still another object of the present invention is to provide an improved cable sheath connector assemble with a telephone cable or the like.

BRIEF SUMMARY OF THE INVENTION

In accordance with the present invention, there is provided an improved cable sheath connector for use with a communication cable such as a telephone cable. Such telephone cables generally have a plurality of insulated metallic conductor wires held in cylindrical form by an inner insulating plastic film wrapped tightly around the conductors, and a thin metallic shield is placed over the plastic film with a final outer protective insulating cover, usually of a dielectric polymer, such as polyethylene.

The cable sheath connector according to the present invention includes (1) an inner base and stud member having an elongated base portion arced in cross section to conform to the inner surface of a metal shield of the telephone cable and a stud portion extending radially outwardly from the base portion; and (2) an outer clamp sember. The outer clamp member is provided with an elongated body portion arced in cross section to conform generally to the outer surface of the telephone cable, and is provided with a plurality of inwardly extending projections, symmetrically arranged, and preferrably projecting from each of the four corners of the body portion. Each of the projections is provided with a flat contact area adapted to penetrate the outer protective cover of the telephone cable and to engage the metallic shield in metal to metal contact.

The outer clamp member is assembled on the stud portion of the inner base and stud member, and tightening of the nut applies compressive pressure between the base and stud member and the outer clamp member.

The material of the outer clamp member is sufficiently resilient so that the projections will penetrate through the outer protective cover of the telephone cable, and will engage in metal to metal contact with the metallic shield, and will apply and maintain a compressive load on the setallic shield clamped between the inner base member and the outer clamp, without puncturing the metallic shield.

In accordance with another feature of the present invention, there is provided an improved assembly of a telephone cable and cable sheath connector of the type according to the present invention.

In assembly of the cable sheath connector with a telephone cable, the outer cover and metallic shield would be split axially at the end of the cable, and the inner base would be inserted through the slit with the stud extending out. The cable would then be wrapped in the area of the slit with vinyl insulating tape to close the slit, and the outer clamp member assembled over the stud with the projections of the outer clamp member projecting inwardly. A nut is tightened on the stud to secure the connector, and to drive the projections through the outer cover of the cable extruding all the organic material from the contact area and engaging the metallic shield of the cable.

Advantageously, the ends of the projections have the flat contact area so that sufficient pressure is developed to extrude the organic materials from the contact area, including the outer cover and any plastic coating that is sometimes used on the metallic shield foil, and to bring about intimate metal to metal contact between the ends of the projections, the metallic shield, and the base, without puncturing or tearing the thin metallic shield. Moreover, due to the symmetrical contact geometry between the projection ends and the inner base, there is provided an elastic strain established in the system so that the high contact commpression is maintained over a wide range of temperatures and for a long duration.

The compressive load may tend to flatten the usually soft metal of the metallic shield foil, generally aluminum, but the flat contact areas of the projections will not penetrate through the metallic shield. Thus, the elastic strain maintains a spring clamp of metal to metal without a layer of organic material between the projections.

Another important advantage resulting from the conductor geometry is that the wide cylindrical shape of the projections on the outer clamp member clamp into and hold the outer cover close to the central stud tending to close the slit in the cover and maintain the cylindrical form of the cable.

BRIEF DESCRIPTION OF DRAWINGS

Referring now to the drawings.

DESCRIPTION OF PREFERRED EMBODIMENT

Figure 1:
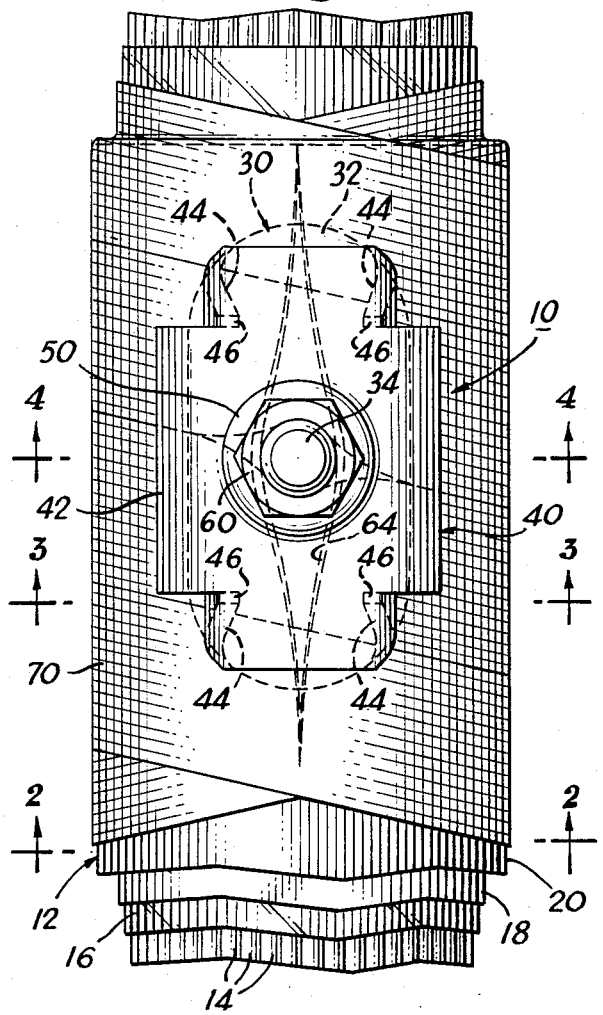
FIG. 1 is a top elevational view of the combination of a cable sheath connector with a cable.
Figure 3:
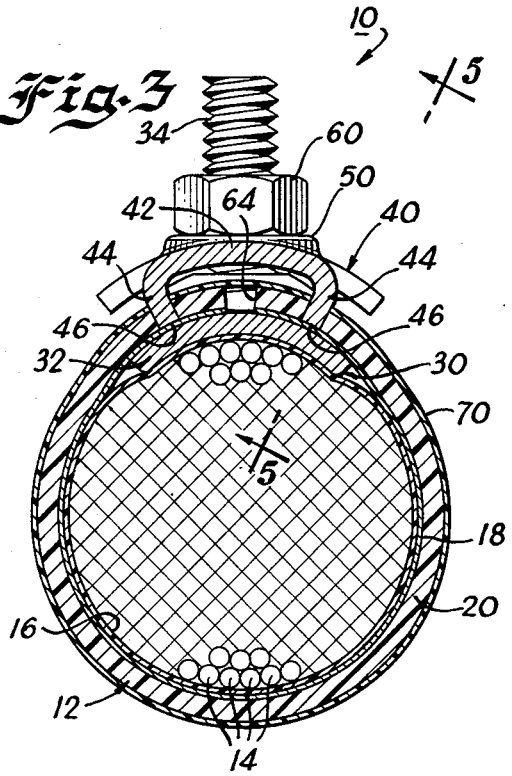
FIG. 3 is a cross-sectional view of the cable and connector combination of FIG. 1 taken along line 3—3 of FIG. 1, taken through a pair of projections.
Figure 2:
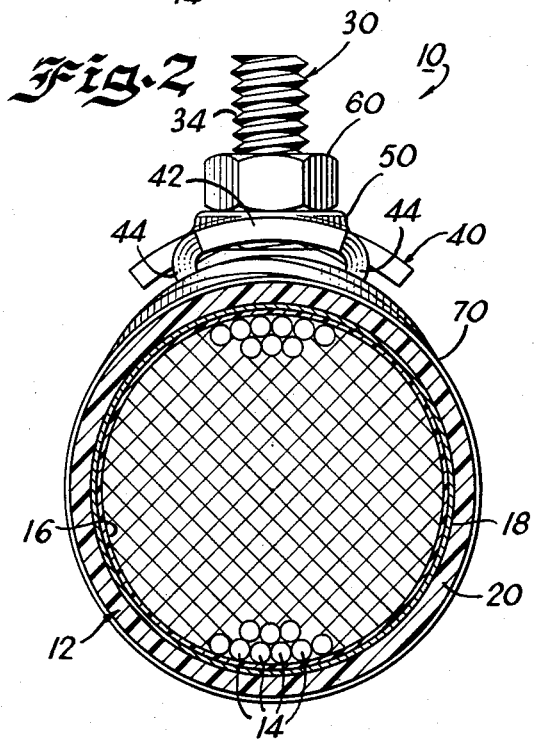
FIG. 2 is a cross-sectional view of the cable and connector combination of FIG. 1 taken along line 2—2 of FIG. 1.

Referring now to the drawings, and particularly to FIGS. 1 through 5, there is illustrated a cable sheath connector 10 assembled to a communication cable 12 according to the present invention.

The communication cable 12 is of a known type, having a plurality 14 of insulated conductor wires covered with an inner insulating plastic film 16, a thin metallic shield 18, and an outer protective cover 20. The metallic shield 18 may be of aluminum foil. The outer protective cover 20 is usually a dielectric polymner such as polyethylene providing mechanical strength and a barrier to moisture and other enviromental conditions. The metallic shield 18 is a necessary element in the cable structure in that it serves to protect the inner electric circuits from disturbing effects of enviromental electrical phenomena, such as lightning and electric power systems. In order to carry on this important function the cable shield must be securely connected to ground at intervals, and interconnected at cable splices. These connections between the shield and ground, and shield to shield must be of high integrity, that is maintaining very low resistance under all enviromental conditions such as mechanical stress, vibration, and thermal change and must be capable of carrying the high surge currents which may occur from lightning or electric power systems faults to ground.

The cable sheath connector 10 comprises an inner base and stud member 20 and an outer clamp member 30, secured when assembled by a torsion nut 60. The inner base and stud member has an elongated base portion 32 arced in cross section to conform to the inner surface of the metallic shield 18 of the communication cable 12, with a stud portion 34 extending radially outwardly from the base portion 32.

The outer clamp member 40 has a generally elongated body portion 42 arced in cross section to conform generally to the outer surface of the communication cable 12, which is provided with a plurality of projections 44 extending inwardly. Each of the projections 44 terminates in a flat contact surface 46 adapted to penetrate the outer protective cover 20 of a communication cable 10, and to engage in metal to metal contact with the metallic shield 18 thereof. The cable sheath connector is designed, when assembled with the communication cable 10, that the flat contact surfaces 46 will apply and maintain compression of the metal shield 18 between the base and stud member 30 and the outer clamp member 40 without puncturing through the metal shield. The body portion 42 is generouslly rectangular, with the projections arranged symmetrically at the four corners of the body portion. In the illustrated embodiment, the flat contact surfaces 46 have an area of 0.002 square inches each. The body portion is provided with a central aperture 48 to receive the stud portion 34, and a boss 50 may be provided to form a seat for the torsion nut 60 when assembled.

Figure 7:
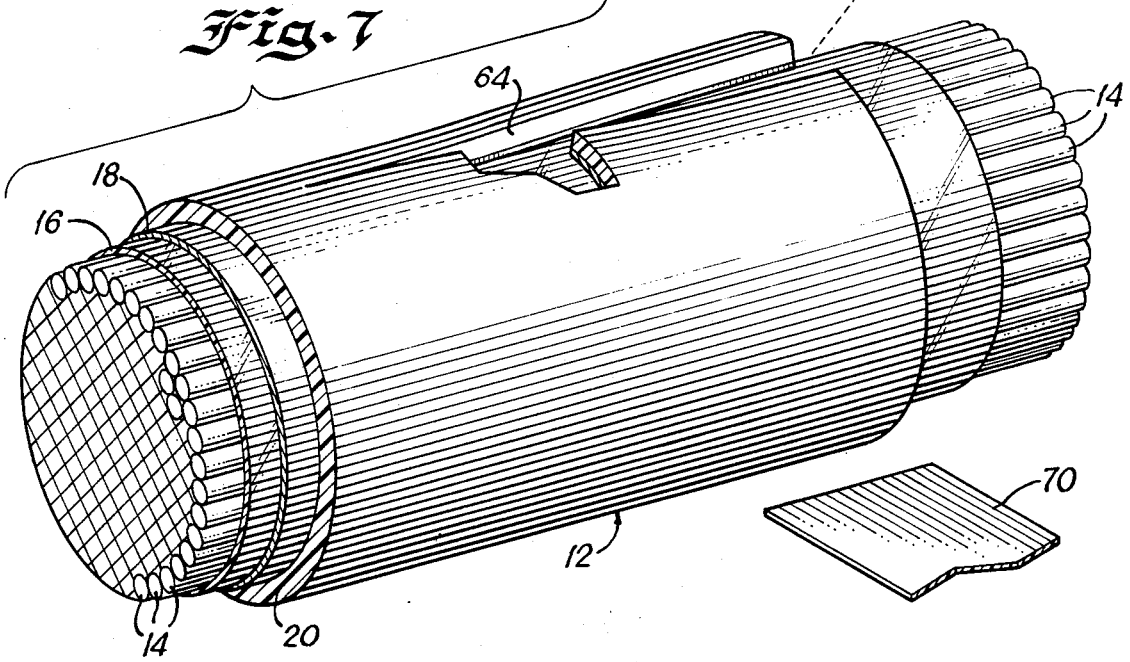
FIG. 7 is an exploded perspective view of the cable and connector combination of FIG. 1.

From the foregoing description of a cable sheath connector 10 and a communication cable 12, the assembly of the sheath connector 10 with the communcation cable 12 should be apparent. However, briefly, the communication cable 12 is first prepared by forming a slit 64 in the protective cover 20 and the metallic shield 18, approximately 2 inches long as best illustrated in FIG. 7. The inner base and stud member 30 is then inserted through the slit, with the body portion thereof against the inner surface of the metallic shield 18. The outer clamp member 40 is then inserted over the stud. The torsion nut is tightened to extrude all the organic materials from the contact area, including the outer protective cover, and any plastic coating that may have been used on the metallic shield, so as to bring about intimate metal to metal contact between the ends or flat contact areas 46 of the projections 44, the metallic shield 18, and the upper or outer surface of the base portion 32.

In the illustrated embodiments, the torsion nut is drawn up tight to about 20 inch pounds of torque. This presses each of the projections 44 inwardly toward the base portion 32 with a force of 25 pounds each. Since in the illustrated embodiment the projections have a flat contact area of about 0.002 inches, 20 inch pounds of torque on the torsion nut 60 produces about 10,000 pounds per square inch pressure on the flat interface areas of the four projections 44.

Due to the symetrical four point contact geometry between the outer clamp member 40 and the inner base and stud member 30, there is elastic strain established in the system so that the high contact compression is maintained over a wide range of temperature and long duration. This has been demonstrated by the ability of the connector of this construction to carry the industry test surge of 1,000 amperes for 20 seconds without any sign of distress and to maintain a very low connection resistance before and after extensive thermal cycling and surge testing.

After iinstallation of the connector 10 with the cable 12, the cable 12 is wrapped with an insulating tape 70, such as of vinyl, so as to close the slit 64.

Figure 4:
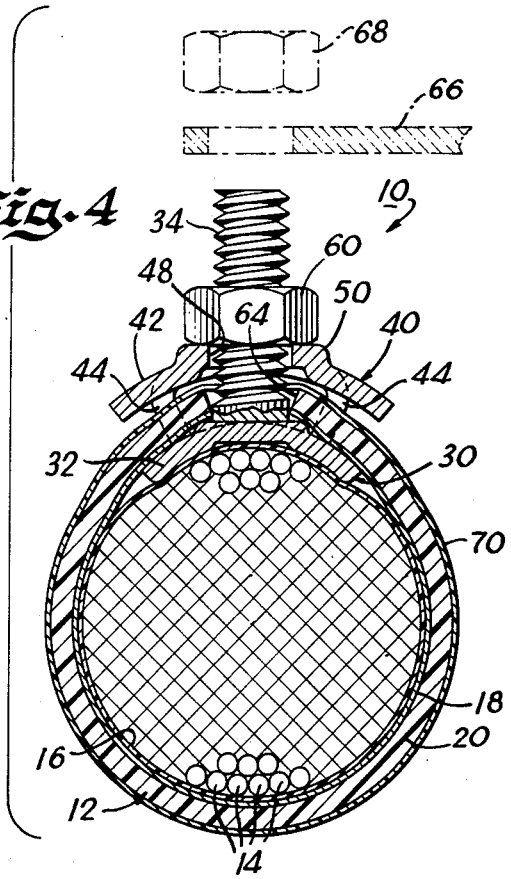
FIG. 4 is a cross-sectional view of the cable and connector combination of FIG. 1 taken along line 3—3 of FIG. 1, taken through the center of the stud.
Figure 5:
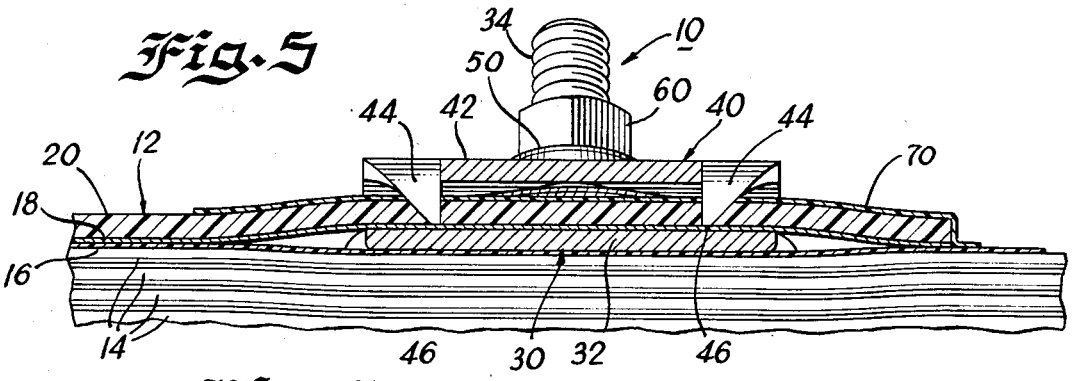
FIG. 5 is a partial side view of the cable and connector combination of FIG. 1, in cross-section.
Figure 6:
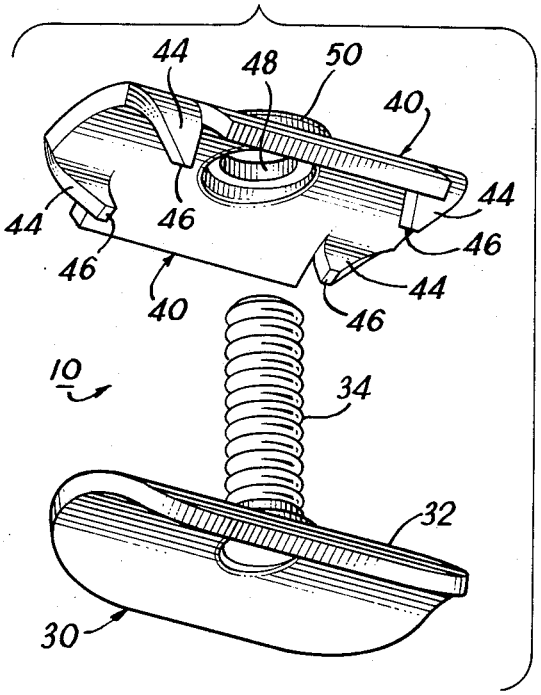
FIG. 6 is a perspective view of the sheath connector of FIG. 1 according to the present invention.
Figure 6:
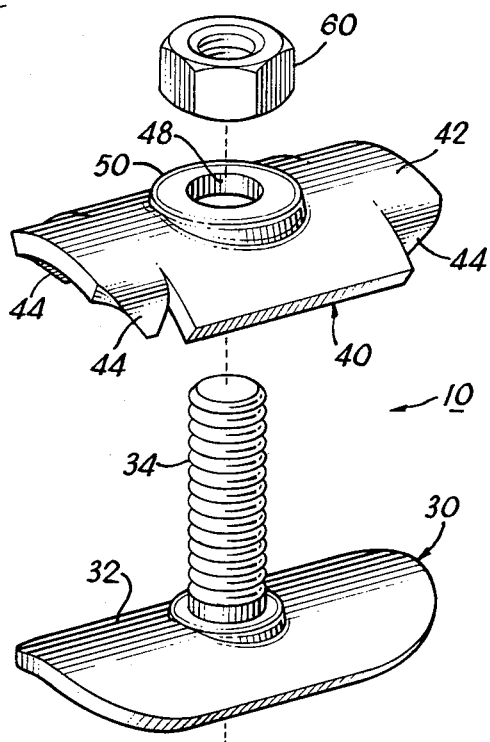

As shown in phantom in FIG. 4, a ground connector 66 can be secured to the stud portion 34 of the inner base and stud member 30 by a suitable ground connector nut 68.

What we claim as new, and desire to secure by Letters Patent of the United States is:

1. A cable sheath connector for use with a communication cable of the type having a plurality of insulated metallic conductor wires held in cylindrical form by inner insulating plastic film wrapped tightly around said conductors and a thin metallic shield placed over the plastic film with a final outer protective insulating cover, said connector comprising:

(a) an inner base and stud member having an elongated base portion arced in cross section to conform to the inner surface of a metal shield of a communication cable, and a stud portion extending radially outwardly from said base portion;

(b) an outer clamp member a generally rectangular body portion elongated in the axial direction and arced in cross section to conform generally to the outer surface of a communication cable, said body portion having projections at its corners, said projections extending radially inwardly and converging inwardly to define axially and radially spaced projections, each of said projections being provided at its projecting tip with a flat contact contact surface adapted to penetrate the outer protective cover of a communication cable and to engage in metal to metal contact under resilient spring load with a metal shield and to apply and maintain compressive spring load on a metal shield clamped between said base and stud member and said outer clamp member without puncturing the metal shield; said body portion having a central aperture and assembled over said stud portion with said stud portion extending through said aperture; and (c) nut means assembled on said stud portion for applying compressive spring pressure between said base and stud member and said outer clamp member.

2. A cable sheath connector as set forth in claim 1 above wherein said body portion is generally rectangular, and the projections on said outer clamp member are arranged symmetrically at the four corners of the body portion.

3. A cable sheath connector as set forth in claim 2 above wherein the flat contact area on said projections is in the area of 0.002 square inches each.

4. In combination:

(a) a communication cable having a plurality of insulated metallic conductive wires, inner insulating plastic film wrapped tightly around said conductors, a thin metallic shield placed over the plastic film, and an outer protective insulating cover, said shield and outer cover having an axially extending slit, and (b) a cable sheath connector including:

(1) a base and stud member having an elongated base portion arced in cross section to conform to the inner surface of a metallic shield and a stud portion extending radially outwardly therefrom, said base and stud member being assembled with said cable with the base portion against the inner surface of the metallic shield and the stud portion extending through said slit;

(2) an outer clamp having a generally rectangular body portion elongated in the direction of said cable and arced in cross section to conform generally to the outer surface of said cable, having a central aperture assembled over said stud portion, and having projections at its corners, said projections extending radially inwardly and converging inwardly to define axially and radially spaced projections, each of the projections being provided at its projecting tip with a flat contact area penetrating the outer protective cover and resiliently clamping the shield against the base portion in metal to metal contact under spring load and maintaining said compressive spring load on said shield; and (3) nut means assembled on said stud portion applying said compressive spring load against said outer clamp and clamping said shield between said projections and said base portion without puncturing through said metallic shield.

5. The combination set forth in claim 4 wherein the flat contact areas are in the area of 0.0002 square inches each, said nut means being tightened in the range of 20 inch pounds of torque, whereby the contact pressure of each of said projections is in the area of 10,000 pounds per square inch pressure.

6. The combination set forth in claim 4 above and additionally including a vinyl insulating tape wrapped around said slit closing said slit, and said projections extend through said tape and said outer cover engaging said shield in metal to metal contact.

* * * * *